US011202935B2

(12) United States Patent
D'Alesio

(10) Patent No.: US 11,202,935 B2
(45) Date of Patent: Dec. 21, 2021

(54) DEVICE FOR MUSCLES AND BALANCE DEVELOPMENT

(71) Applicant: REAXING S.R.L., Milan (IT)

(72) Inventor: Gionata D'Alesio, Milan (IT)

(73) Assignee: REAXING S.R.L., Milan (IT)

( * ) Notice: Subject to any disclaimer, the term of this patent is extended or adjusted under 35 U.S.C. 154(b) by 0 days.

(21) Appl. No.: 16/761,840

(22) PCT Filed: Nov. 6, 2018

(86) PCT No.: PCT/IB2018/058713
§ 371 (c)(1),
(2) Date: May 6, 2020

(87) PCT Pub. No.: WO2019/092595
PCT Pub. Date: May 16, 2019

(65) Prior Publication Data

US 2021/0197027 A1 Jul. 1, 2021

(30) Foreign Application Priority Data

Nov. 7, 2017 (IT) ..... 102017000126717

(51) Int. Cl.
*A63B 26/00* (2006.01)

(52) U.S. Cl.
CPC .... *A63B 26/003* (2013.01); *A63B 2208/0204* (2013.01); *A63B 2220/833* (2013.01); *A63B 2230/067* (2013.01)

(58) Field of Classification Search
CPC ..... A63B 7/00; A63B 22/02; A63B 21/4043; A63B 21/0552; A63B 23/03541;
(Continued)

(56) References Cited

U.S. PATENT DOCUMENTS 3,083,037 A * 3/1963 Gordon ..... A63B 19/04 280/206
4,431,184 A * 2/1984 Lew ..... A63B 7/00 482/102

(Continued)

FOREIGN PATENT DOCUMENTS

WO 99/42189 A1 8/1999
WO 03/092824 A1 11/2003
WO 2017/130112 A1 8/2017

OTHER PUBLICATIONS

International Search Report, dated Nov. 6, 2018, from corresponding PCT application No. PCT/IB2018/058713.

(Continued)

*Primary Examiner* — Garrett K Atkinson
(74) *Attorney, Agent, or Firm* — Nixon & Vanderhye

(57) ABSTRACT

Disclosed is a device for exercising muscles and balance including a board with a support surface to accommodate at least one person performing a physical exercise, a static support structure, a suspension between the static structure and the board adapted to maintain this latter suspended and raised off the ground and first actuator of the suspension mounted on the static structure, in which the suspension includes elongated flexible elements with a first end connected to the first actuator and a second opposite end connected to the board, the actuator being controllable by a control unit adapted to generate a sequence of activation and deactivation signals to move the suspension and, therefore, to vary the height or the tilt of the board or both.

20 Claims, 7 Drawing Sheets

(58) Field of Classification Search
CPC ..... A63B 21/008; A63B 21/4007; A63B 23/03575; A63B 21/4015; A63B 23/1209; A63B 21/16; A63B 21/4011; A63B 23/0238; A63B 21/285; A63B 21/4034; A63B 21/00069; A63B 21/4009; A63B 23/0405; A63B 23/03533; A63B 21/151; A63B 21/068; A63B 21/023; A63B 5/11; A63B 71/0622; A63B 21/4035; A63B 21/169; A63B 21/0088; A63B 21/005; A63B 21/0442; A63B 21/00181; A63B 69/0057; A63B 21/06; A63B 21/0603; A63B 2225/09; A63B 2209/10; A63B 2208/029; A63B 2220/50; A63B 2225/093; A63B 2022/0094; A63B 2208/0223; A63B 2208/0228; A63B 2208/0204; A63B 2208/0214; A63B 26/003; A63B 2220/833; A63B 2230/067
See application file for complete search history.

(56) References Cited

U.S. PATENT DOCUMENTS 5,178,590 A * 1/1993 Stephens ..... A63B 7/02 482/23
5,626,540 A * 5/1997 Hall ..... A61H 1/0229 482/69
6,932,710 B1 * 8/2005 Hartin ..... A63B 7/00 472/118
7,014,594 B2 * 3/2006 Stoltz ..... A62B 1/14 482/24
7,147,593 B2 * 12/2006 Vittone ..... A63B 22/16 482/142
7,666,126 B2 * 2/2010 Rempe ..... A63B 22/18 482/143
9,776,030 B1 * 10/2017 Louis ..... A63B 21/068
10,183,194 B1 * 1/2019 Louis ..... A63B 5/11
10,232,209 B2 * 3/2019 Pouchet ..... A63B 23/03575
10,265,565 B2 * 4/2019 Jue ..... A63B 21/00181
10,493,324 B2 * 12/2019 Sbragia ..... A63B 24/0087
10,737,136 B2 * 8/2020 Burkinshaw ..... A63B 71/02
2004/0235619 A1 * 11/2004 Stoltz ..... E06C 7/186 482/24
2005/0209069 A1 * 9/2005 Biernacki ..... A63B 21/068 482/96
2009/0312165 A1 12/2009 Rempe
2010/0130338 A1 * 5/2010 Wehrell ..... A63B 21/154 482/124

OTHER PUBLICATIONS

Written Opinion, dated Nov. 6, 2018, from corresponding PCT application No. PCT/IB2018/058713.

* cited by examiner

DEVICE FOR MUSCLES AND BALANCE DEVELOPMENT

BACKGROUND OF THE INVENTION

Field of the Invention

The present invention relates to a device for developing a person's muscles and balance. More in detail, the invention relates to a device provided with a suspended board with a support surface to support a person performing a physical exercise and optionally sporting equipment. The device is equipped with suspension means of the board connected to actuator means that cause a sequence of movements of said board during the performance of an exercise.

Description of the Related Art

The invention falls within the sector of sporting equipment suitable to stimulate the reaction of the human body to so-called motor interferences, i.e. external stimuli that, during the performance of a movement, can generate a variation of a person's balance.

Usually, training of the muscles of the body involves the performance of free body exercises or exercises with equipment (movable equipment or stationary machines).

During the performance of these exercises, the person or the machine rests on a stable support, such as a floor, a fixed platform or the like.

According to this training method, the person contracts his/her muscles voluntarily to perform a given movement characteristic of the exercise that he/she is performing.

In practice, during the performance of an exercise, any variation of position, acceleration or speed of a part of the body, just as the force exerted by given muscles, is known or in any case predictable by the person performing the exercise.

However, both in the practice of some sporting activities and in normal daily actions, our body is often subjected to external stimuli, predictable or unpredictable, that can interfere with a movement that is being performed or with a condition of stable balance.

For example, during a sporting activity, contact with an opponent or an unexpected change in direction can cause an imbalance that the athlete must compensate as rapidly as possible.

In other cases, these interferences can be generated, especially when running, by incorrect positioning of the foot on the ground, due to a coordination error of the athlete or to an unexpected variation of the ground underfoot.

An event of this kind can also occur during daily activities, such as walking, climbing stairs or in other more precarious conditions of balance.

Examples of motor interferences are also represented, for example, by losing one's grip on and dropping an object and trying to catch it.

In general, the greater the rapidity and unexpectedness of the interference that occurs, the more difficulty the body has in reacting correctly to re-establish the condition of movement, or of unperturbed balance.

In this regard, there are studies that show that this ability of our body to react can be developed and increased with a training method in which motor interferences are suitably imparted to the person during the performance of physical exercises.

US 2009/0312165 A1 describes a suspended board connected to a support structure by flexible and inextensible suspension means and by second flexible and extensible suspension means and by elastic cords. The suspension means are connected to the board at central axis so as to allow it to rotate about said axis. This device thus allows the board to take positions of imbalance, determined solely by the position of the body of the person on the board. The movements of the board are therefore at least in part predictable by the person performing an exercise on it.

WO 2017/130112 A1 describes as platform for performing gymnastic exercises provided with a supporting surface connected to actuator means adapted to tilt the supporting surface or to vary the height of one or more points, to create unpredictable conditions of imbalance. The degrees of freedom of movement of the platform in question are linked to the type of actuators used and to the mechanism with which it is generally connected to the base. To obtain complex movements it is therefore necessary to adopt complicated and costly movement mechanisms. For this reason, this equipment generally only provides vertical movements of the supporting surface, i.e., translations or rotations.

BRIEF SUMMARY OF THE INVENTION

An objective of the present invention is therefore to provide a device that allows a person to perform a physical exercise perturbed by unexpected and unknown motor interferences.

In particular, an object of the present invention is to produce a device that allows artificial reproduction of unexpected and complex movements to which a person, in particular an athlete, could be subjected during the performance of some sporting disciplines.

The object of the present invention is therefore to provide a device that allows a person to perform a plurality of gymnastic exercises, both free body and with the aid of equipment or machines.

Another object of the present invention is to provide a device controllable in real time by a third person, for example a trainer or an instructor.

A further object of the present invention is to provide a device that is less complicated and less costly than those of the prior art.

The aforesaid objects are achieved with a device for exercising muscles and balance comprising:

- a board with a support surface for accommodating at least one person performing a physical exercise;
- a static support structure;
- suspension means of the board between the board and the static structure adapted to maintain said board suspended and raised off the ground; and
- first actuator means of said suspension means positioned on the static structure.

According to the invention, said suspension means comprise elongated flexible elements with a first end connected to the first actuator means and a second opposite connected to the board. The connection or coupling points of the second ends of the suspension means to the board are preferably at the lateral edges or the outer perimeter of this latter. Generally, connection means such as hooks, eyelets, slots, etc. are interposed between the flexible element and the board.

The actuator means are controlled by a control unit adapted to generate a sequence of activation and deactivation signals to move the suspension means and, therefore, to vary the height or the tilt of the board, or both.

In the context of the present invention the term suspended, referred to the board, means that it is held by said suspension means mainly or exclusively from above.

For this purpose, the static support structure is configured so as to provide coupling points of the suspension means to the actuator means positioned at a greater height with respect to the board or is provided with guide means, such as pulleys or the like, arranged in this raised position elevated with respect to the board. In this way, the board is maintained suspended or "hung" by said suspension means.

According to the invention, said suspension means are therefore designed to allow a movement of the board of translational, prevalently along a direction substantially vertical or perpendicular to the ground, or rotational (tilting) type of the board or combinations of these movements. Moreover, the use of flexible elements means that the board, besides the aforesaid vertical translation or tilting movements, is subject to lateral oscillations, these latter which can be determined only or also be the movements of the person's body.

The movements of the board are therefore caused by external stresses with a known, or in any case at least partially predictable, component caused by the person's movements, and an unexpected component, caused by the action of the first actuator means.

Suitable flexible elements are, for example, ropes or cords, belts, chains or the like.

Preferably, the suspension means are substantially inextensible. This ensures that vertical translations or rotations (tilting) of the board are caused only by the movement of the actuator means and not, instead, also by the movements of the person standing on the board. In this way these movements can be controlled and managed precisely by the control unit.

According to another variant of the invention, the suspension means, or a part of these means, can also be extensible or elastic.

The effect of the sequence of activations and deactivations of the first actuator means is to cause a sequence of movements of the board that, in turn, generate motor interferences for the person performing the physical exercise or, in any case, a given movement on it.

These motor interferences, not being known to the person performing the exercise, can simulate unexpected events that occur normally during sporting activity or daily activities. By subjecting the person to these unexpected disturbances, during the performance of a physical exercise or of a specific movement, it is possible to stimulate and train both the muscles of the body, and in particular their reaction ability, and the person's balance.

According to an aspect of the invention, the first actuator means are preferably selected from linear actuators, electric motors, magnetic actuators or pneumatic actuators.

According to another aspect of the invention, said first end of the suspension means can be connected directly to the first actuator means. This configuration is preferable when the actuator means are actuators with linear motion, such as electric or magnetic linear actuators, or pneumatic cylinders.

According to another possible variant, a movement member, such as a pulley or a reel, can be interposed between said first end of the suspension means and said actuator means. These movement members, which can carry the coupling point of the first end, are rotated by the actuator means, for example an electric motor, to wind or unwind the suspension element. This winding or unwinding thus determines a variation of the length, or of the extension, of the portion of the suspension means between the coupling point on the static support structure and the connection point to the board.

Other movement members that can be used are connecting rods, articulated rods or cams.

According to an aspect of the invention, said suspension means comprise at least three flexible elements (ropes, cables, or the like): the first end of each element is connected to first actuator means, and the second end is connected to a fixed point at the perimeter of the board.

According to a preferred variant, the board has a polygonal and more preferably quadrilateral shape. According to this variant, the suspension means can comprise four flexible elements whose second ends are connected at the vertices of the board.

Said first ends of the suspension means can be connected each to a respective actuator or two or more suspension means can be connected to a shared actuator. In this way, it is possible to reduce the number of the actuator means used in the device, however limiting the possible movements of the board.

According to a variant of the invention the static support structure comprises columns arranged along a perimeter around the board. Guide means, such as pulleys, rollers or the like, on which the suspension means run, are mounted on said columns According to this variant, the first actuator means are mounted on said columns or, optionally, in a base of the structure, if provided.

In a particular embodiment, the device can be integrated with a treadmill. In this variant the board is provided with a pair of rollers, rotatingly connected to the board and arranged so that the respective rotation axes are parallel to one another and substantially parallel to the upper surface of the board. A belt is wound around said rollers and arranged so as to have at least an upper branch positioned above said upper surface of the board.

The treadmill can be of passive type, in which the belt is rotated directly by the person walking or running on it, or of active type. In this second case, the device further comprises at least one motor, connected to at least one of said rollers, to rotate the belt. Also said motor is connected to the control unit which manages its activation and deactivation.

According to a variant of the invention, the device can comprise limit stop means adapted to limit or prevent the oscillation movement of the board. In fact, as already mentioned, the flexibility of the suspension means allows the board a further oscillating motion, besides the rotation and vertical translation movements caused by the first actuator means. Said oscillating movement is also, or prevalently, caused by the movements of the person on the board. Said limit stop means are therefore configured to limit the lateral movements of the board during the oscillating motion or to exclude them.

According to a possible embodiment, said limit stop means can comprise limiters positioned on the static support structure. The limiters are adapted to interfere directly with the board or with an abutment element fixed to this latter, preferably solidly.

Said limiters can, for example, be side walls positioned at the lateral edge of the board at a given distance from it. The distance of said side walls is preferably adjustable so as to vary the amplitude of the lateral movements allowed optionally also in a different manner for oscillations in directions transverse to one another.

According to an alternative embodiment, the board is provided with an abutment element, preferably projecting from the upper face, adapted to cooperate with the aforesaid side walls. In this variant, a single side wall with a closed perimeter could also be provided.

Preferably, the side walls are mounted on elastic supports or are themselves made of a deformable material so as to dampen the impact of the board or of the abutment element against them.

According to another possible embodiment, said limit stop means can comprise magnetic means, such as permanent magnets or electromagnets, attached to the static support structure, to the board or to both.

According to another possible embodiment, said limit stop means can comprise limiters mounted on the static support structure adapted to interact with the flexible elements to reduce the length of the portion that can oscillate and, therefore, the oscillation amplitude of the platform.

For example, said limiters can comprise jaws, annular elements or the like, that surround the flexible element. Preferably, said limiters are movable along a substantially vertical direction to vary the point in which the flexible element is constrained. In this way it is possible to vary the length of the portion of flexible element that can oscillate.

According to another variant, the device can also comprise second actuator means, connected to the control unit, adapted to cause oscillating movements of the board. Said movements are therefore generated in a manner controlled by the control unit and, just as the translation and rotation movements, are adapted to generate motor interferences that tend to destabilize the person on the board.

According to this variant, said second actuator means can also act as limit stop means to limit or prevent the oscillating movement.

Examples of said second actuator means are, for example, electromagnets mounted as described above, conventional actuators, motors or linear actuators, connected directly to the board or, preferably, by means of flexible elements such as cords, ropes or the like.

According to another aspect of the invention, the control unit is configured to calculate both the activation and deactivation times of the first actuator means, and therefore the duration of an activation cycle, and the rest or deactivation time between one activation cycle and the next.

Preferably, the rest or deactivation time between one activation cycle and the next is different at least to the previous one, so that the movement of the board is not predictable or expected by the person standing on it.

According to a possible embodiment, the activation and deactivation time intervals are random and are generated in real time by the control unit during use of the device, or are stored in a memory of said control unit.

Alternatively, the activation and deactivation times of said first actuator means are imparted by a specific user, such as a trainer, by means of a control interface connected to the control unit.

According to an aspect of the invention, said control unit is configured to vary, adjust or control one or more of the following parameters concerning the movements of the board:

- the acceleration, the speed, or the amplitude of vertical movement or of rotation (tilting), or of both;
- the direction of vertical movement or the direction of rotation (tilting), or both.

According to another aspect of the invention, the device is equipped with sensor means, operatively connected to the control unit, configured to measure at least one parameter concerning the person performing the exercise. Said parameter is selected from the person's energy expenditure or heart rate or is linked to the position, speed or acceleration of one or more parts of the body of the person performing the exercise on the board.

BRIEF DESCRIPTION OF THE DRAWINGS

Further features and details of the invention will be better understood from the description below, provided by way of non-limiting example, and from the accompanying drawings, wherein.

DETAILED DESCRIPTION OF THE PREFERRED EMBODIMENTS

Figure 1:
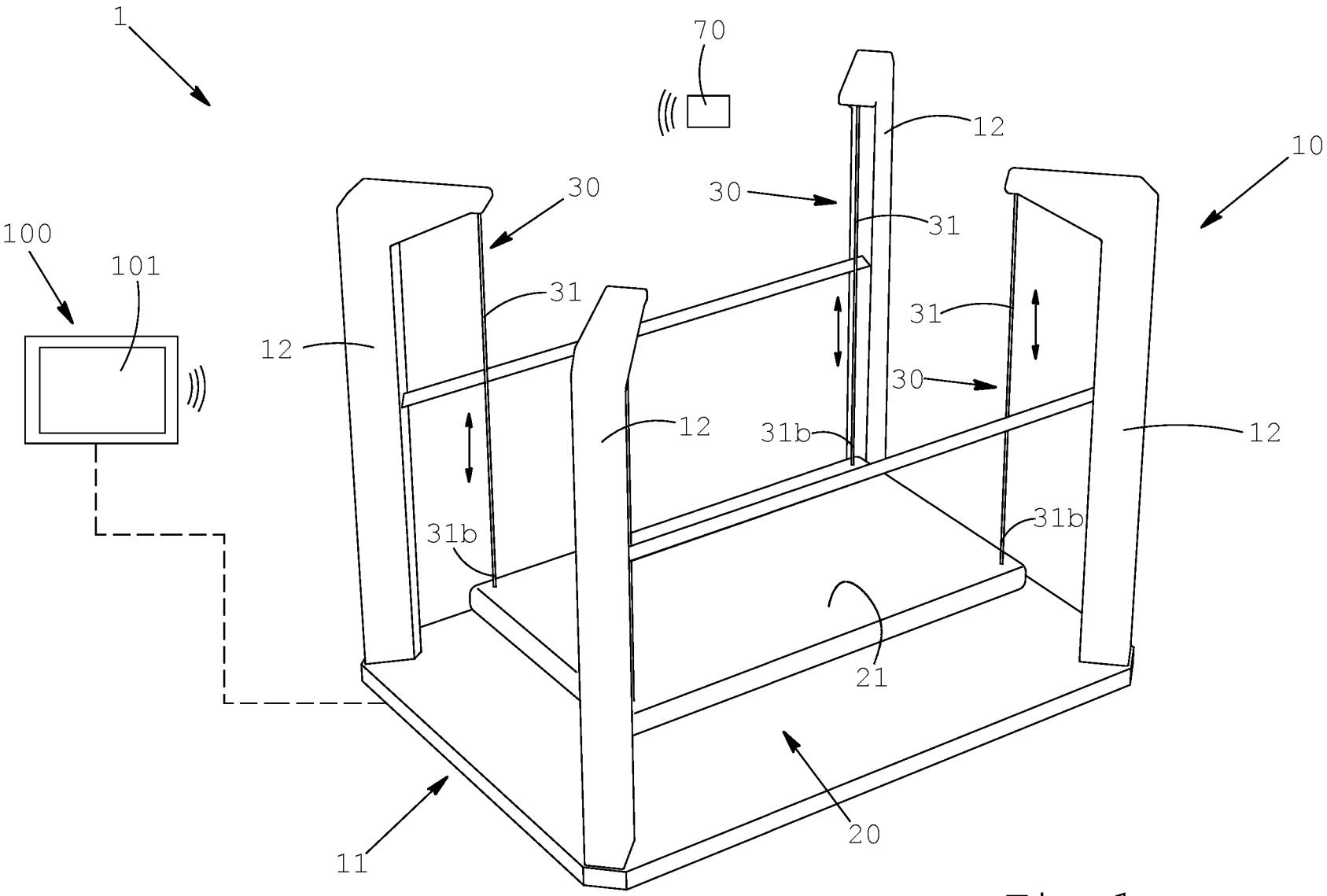
FIG. 1 is a perspective view of the device for developing muscles and balance according to the invention.

With reference to the accompanying figures, FIG. 1 indicates as a whole with the reference numeral 1 the device for developing muscles and balance. The device 1 comprises a static support structure 10 and a board 20, which offers a support surface 21 adapted to accommodate at least one person. As a function of the dimensions and of the shape of the board 20, the person can perform physical exercises on it in different positions, for example while standing, lying down or in other positions. Preferably, the board can also accommodate fixed or movable sporting equipment, that can be used by the person to perform physical exercises.

The static support structure 10 comprises a base 11, adapted to rest on the ground, and columns 12 that extend upward and surround the board 20. In the example of the figures, the base 11 has a quadrilateral shape and the columns 12, four in this case, are positioned at the vertices of the base 11. However, the number of columns 12 be larger or smaller as a function of requirements.

According to another variant, not illustrated, said static support structure 10 can be fixed to the ceiling or to the wall of a room. In this case, the structure can have different shapes from the one described above.

According to a preferred variant, the board 20 comprises a substantially rigid table, i.e., not deformable if loaded with the weight of the person or of any equipment. The material with which the table is produced can be a plastic, wooden or metal material. The structure of the table can be solid, i.e., monolithic, or can comprise a covered rigid frame. Said covering can be made of a soft or yielding material, such as an expanded material.

According to another possible variant the board 20 can comprise a bag of flattened shape, inflatable with air or with a gas so as to make it sufficiently rigid to support a person.

The board 20 has a preferably polygonal, and more preferably quadrilateral, planform, as in the example illustrated. Alternatively, the board can be oval or round.

The support surface 21 of the board 20 is typically flat or substantially flat.

The board 20 is connected to the static support structure 10 by means of suspension means 30 adapted to maintain the board 20 raised off the ground and allow it to perform given movements in space.

In the examples of the accompanying figures, said suspension means 30 comprise flexible elements 31, such as ropes or cords. Said flexible elements are connected at a first end 31*a* to a respective coupling point 13 of the static support structure 10 (FIGS. 2 and 4) and at a second end 31*b* to the board 20.

According to the invention, said coupling point is on or is connected to first actuator means 40, also mounted on the support structure 10.

A control unit 100 is connected to said first actuator means 40 and controls its deactivation to move the coupling point 13 and consequently the position of the flexible element 31 or at least of its second end 31*b*.

Figure 2:
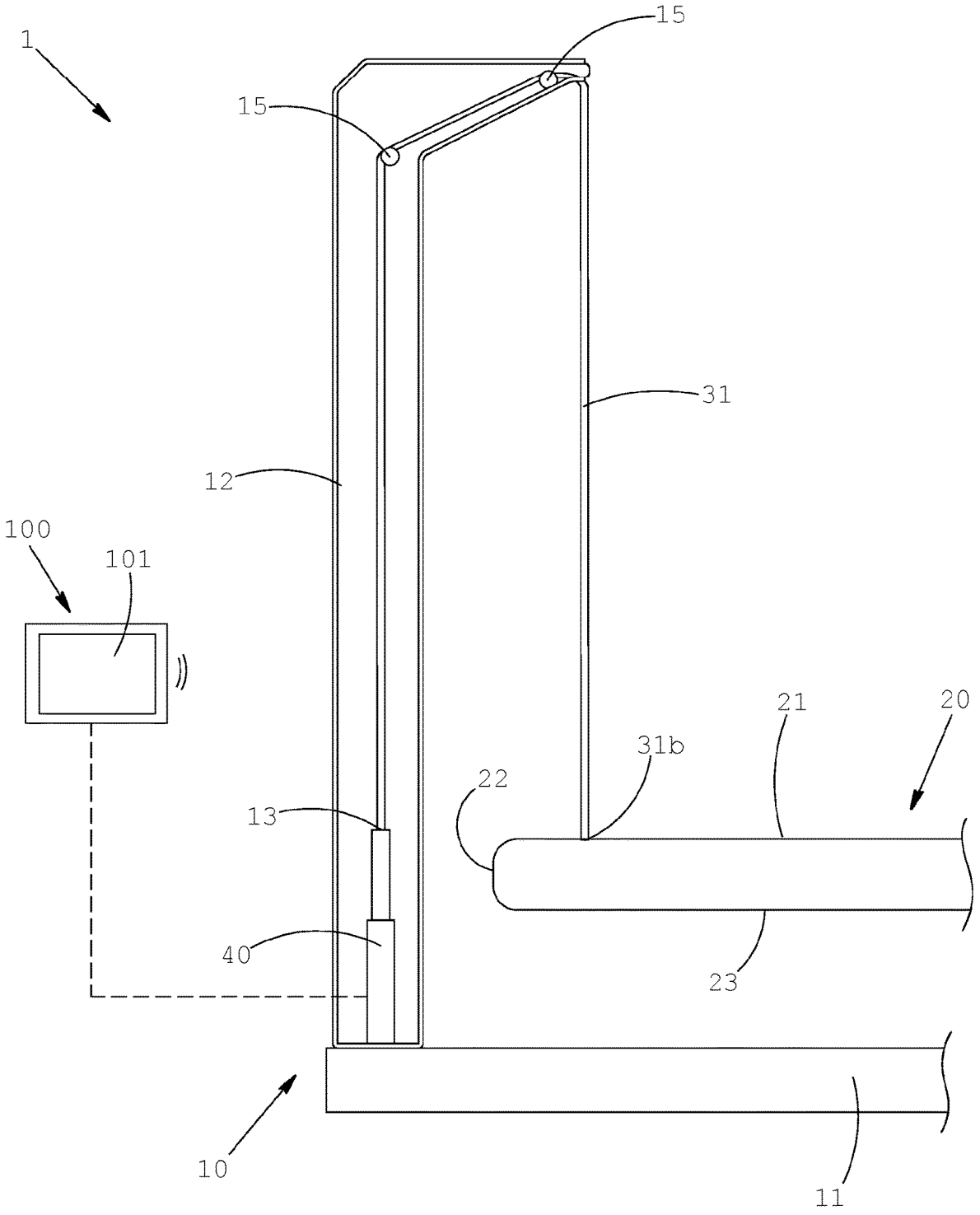
FIG. 2 is a sectional view of a detail of the device of FIG. 1.

According to a first embodiment of the invention, illustrated in FIGS. 1 and 2, the first actuator means 40 are mounted on the columns 12 of the static support structure 10. More precisely, each column 12 is provided with an actuator means 40 connected to a respective flexible element 31.

According to this embodiment, each flexible element 31 is wound or in any case runs on guide pulleys 15 mounted rotatable on the columns 12. At least one of said pulleys 15 is positioned in proximity to a distal end of the column 12 or in any case at a greater height with respect to that of the board 20 in the rest position, i.e., substantially parallel to the ground.

The task of the pulleys 15 is to divert and guide the flexible element 31 from the distal end of the column 12 toward the point in which the first actuator means 40 are positioned.

According to the invention, alternatively to the pulleys other guide means can be used to divert the direction of extension of the flexible element between the coupling point on the board 20 and the one on the actuator means 40.

The columns 12 have a height that can vary as a function both of the type of exercise to be performed on the board and of the amplitude of movement required. The height is typically comprised between 0.5 and 2.5 m.

For example, as in the variant of FIG. 1, the columns 12 can have a height comprised between 1.5 and 2.5 meters.

Figure 6:
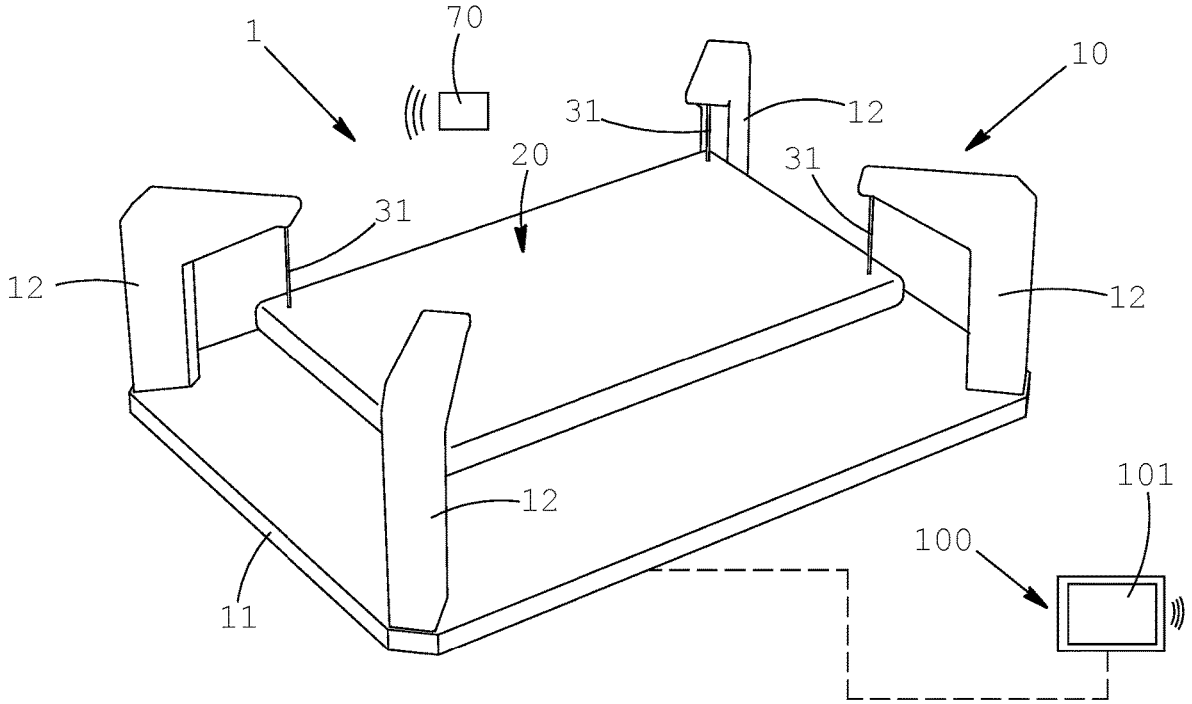
FIG. 6 is a perspective view of the device according to another variant of the invention.

Nonetheless, the columns 12 can be lower, for example 0.5-1 meter, as in the variant of FIG. 6. In this variant, the space around the board 20 is substantially free so as to allow a person to perform exercises in which the parts of the body or any equipment held could project beyond the perimeter along which the columns 12 are arranged.

According to the invention, the first actuator means 40 can be of various type.

According to a possible embodiment, not illustrated in the figures, the first actuator means 40 can comprise an electric motor connected to a reel on which the first end 31*a* of the flexible element 31 is fixed. Rotation of the reel causes winding or unwinding of the flexible element 31 and, varying its length, causes movement of the second end 31*b* of this latter and of the coupling point on the board 20.

Actuation of the first actuator means 40 by the control unit 100 thus allows substantially vertical translation movements to be imparted to the board, when all the flexible elements 31 are wound or unwound in a coordinated manner, or of the rotations (or tilting) in different directions winding or unwinding only some of the flexible elements 31 or winding some and unwinding others.

According to another embodiment, the first end 31*a* of the flexible element 31 can be connected to an electric or pneumatic linear actuator, whose movement determines the movement of the board in the manner described above.

Said actuator means can comprise an intermediate transmission member, such as an articulated lever, a cam or the like, on which the first end 31*a* of the flexible element 31 is fixed.

The examples described above are provided purely by way of non-limiting example within the scope of the present invention.

Figure 3:
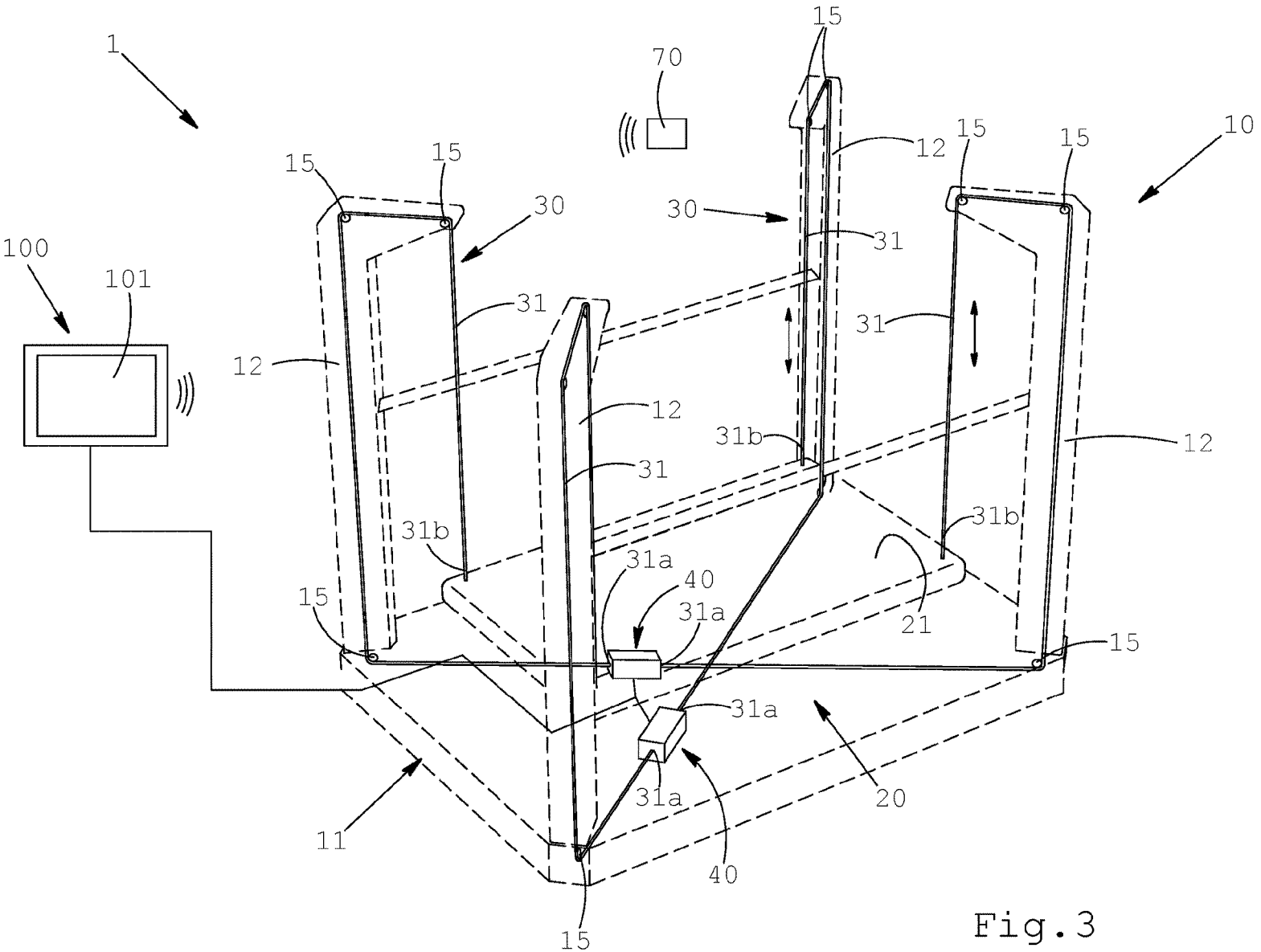
FIG. 3 is a perspective view of the device according to a variant of the invention.

According to another variant of the invention, illustrated in FIG. 3, the first actuator means 40 are positioned in the base 11 of the static structure 10.

According to a particular embodiment, the first ends 31*a* of two flexible elements 31 are connected to a common single actuator means 40.

In this way the movement caused by said actuator means 40 determines the simultaneous movement of the second ends 31*b* of the two respective flexible elements 31.

The flexible elements 31 connected to the same coupling point 13 can be those connected to the opposite vertices of the board, as in the example represented in FIG. 3, or, alternatively, they can be those connected to consecutive vertices.

In this variant the device is simplified as the number of actuators is reduced 40.

According to another variant of the invention, the device comprises limit stop means 50 adapted to limit the oscillating movement of the board 20 or, optionally, to prevent it entirely. Oscillating movement is meant as lateral movements of the board 20 due to the fact that this latter is held suspended by the flexible elements 31, which allow an oscillating motion in the manner of a pendulum.

FIGS. 4*a* to 4*f* illustrate some examples of embodiment of said limit stop means 50.

Figure 4A:
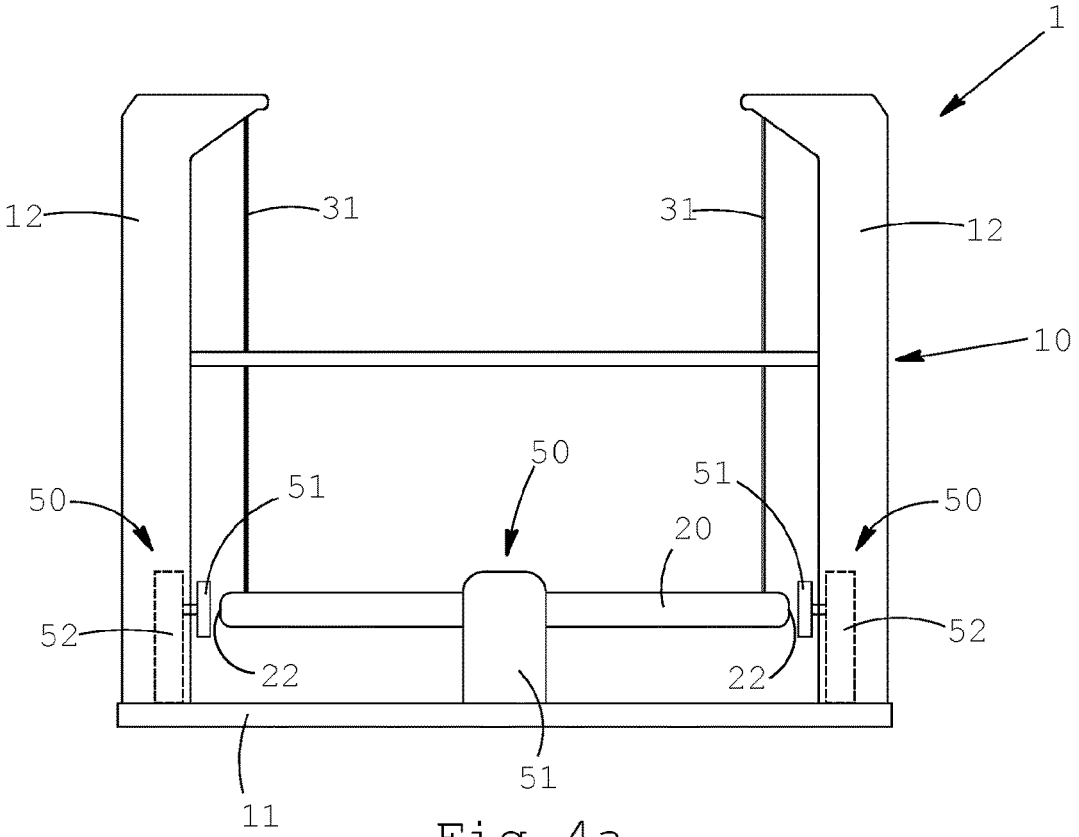
FIGS. 4*a* to 4*f* are lateral views of the device according to some variants of the invention.

In the example of FIG. 4*a*, the device comprises side walls 51, arranged at the perimeter of the static support structure 10 at a given distance from the lateral edge 22 of the board 20 in a rest condition.

Preferably, said side walls are mounted on adjustable supports so as to vary the range of the lateral movements of the board 20. Even more preferably, said side walls are mounted on elastic supports 52 so as to dampen any impacts of the board 20. Moreover, alternatively, for the same purpose, said side walls 51 can be made of soft or deformable materials, such as rubber, expanded materials or the like.

Figure 4B:
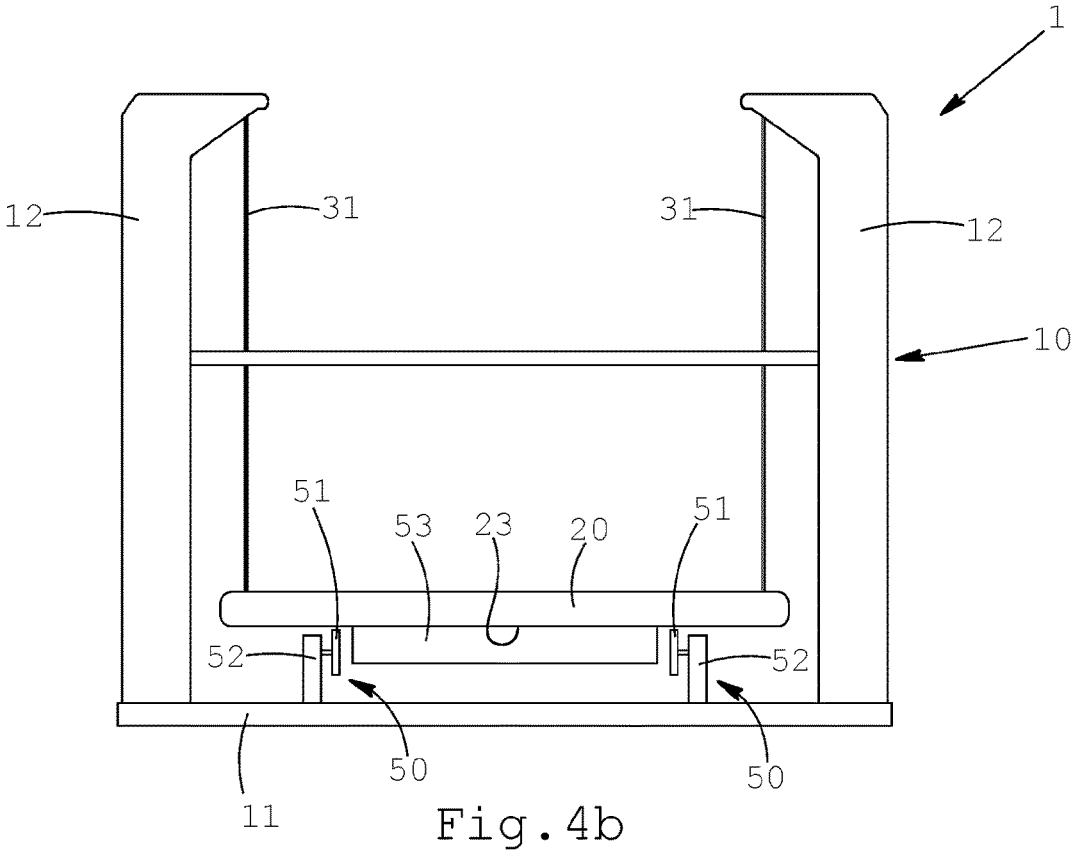

In the variant of FIG. 4*b*, the side walls 51 are positioned below the board 20 and are adapted to co-act with an abutment element 53 projecting from its lower face 23. In this variant said abutment element can be made of rigid material or also of a soft or pliable material, as a function of the how the side walls 51 are made.

Figure 4C:
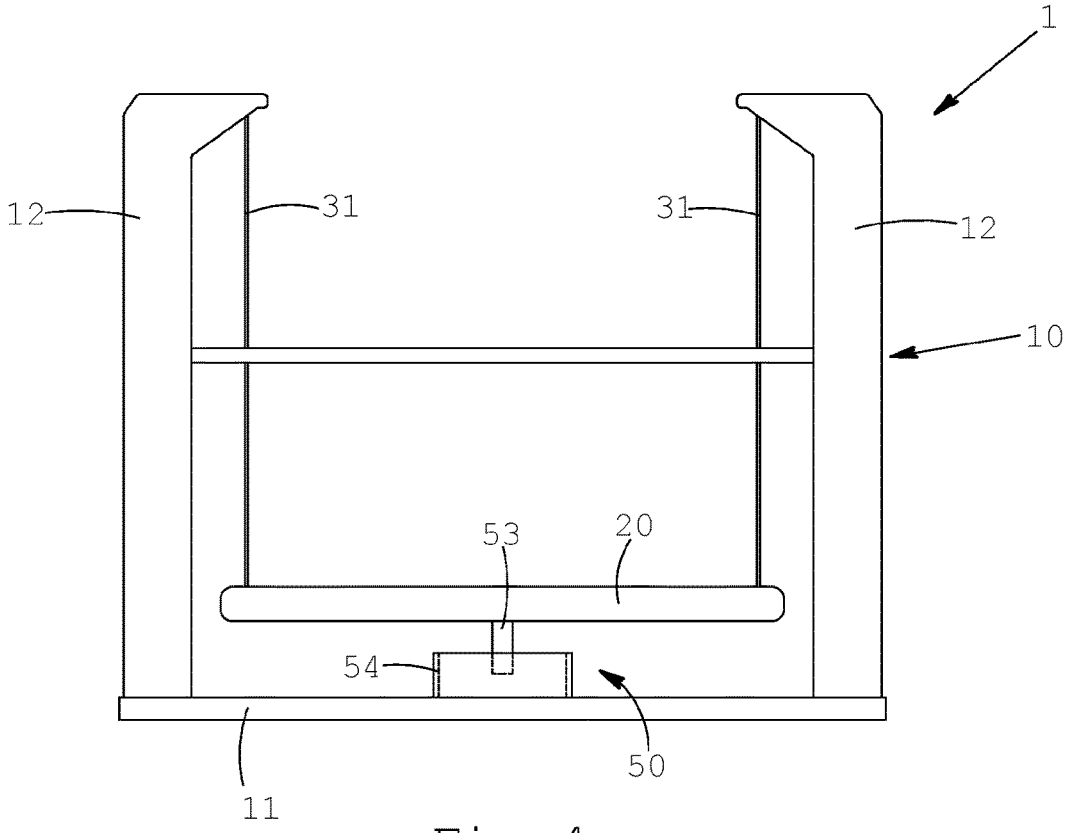

In the example of FIG. 4*c*, the side walls 54 consist of a closed edge element, for example annular in shape, inside the perimeter of which the abutment element 53 projecting from the lower surface 23 of the board 20 can move freely. Said edge element 54 is preferably made of an elastic material.

According to another variant, the abutment element 53 is fixed on the base 11 of the static support structure 10 and the side walls 54, in the shape of the edge element or of separate side walls, are attached to the lower surface 23 of the board.

Figure 4D:
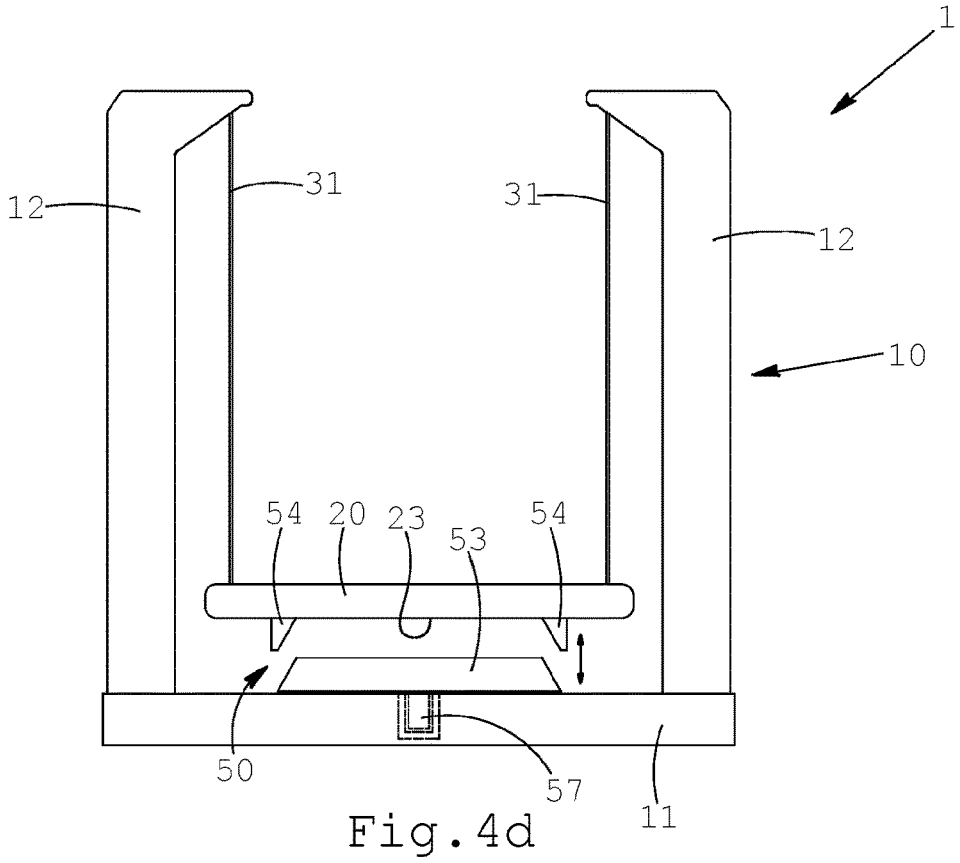

According to yet another variant, illustrated in FIG. 4*d*, the abutment element 53 is mounted movably on the base 11 of the static support structure 10 so as to be able to be raised or lowered by means of an actuator 57. In this way the limit stop element 50 can be completely excluded when the abutment element 53 is in the lowered position or, vice versa, activated when this latter is raised.

Figure 4E:
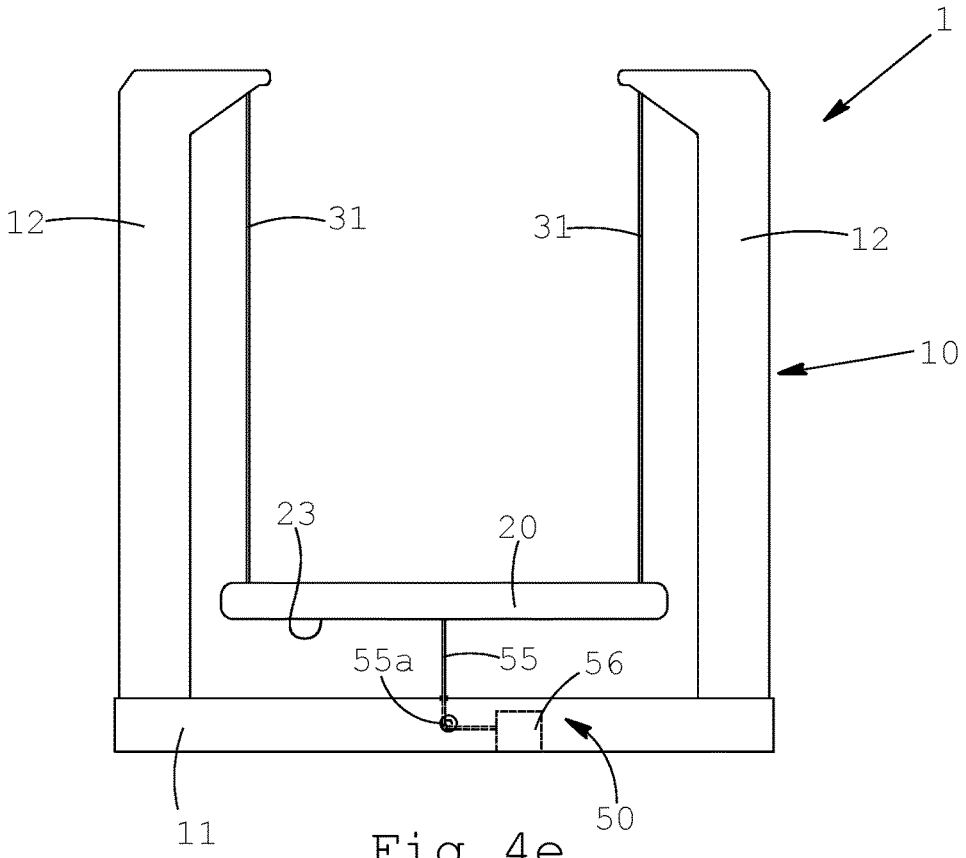

According to a further variant of the invention, illustrated in FIG. 4*e*, the limit stop means 50 comprise a flexible element 55, for example a cable or a cord, fixed to the lower surface 23 of the board 20, connected to an actuator 56, preferably a pulley or reel, connected to an electric motor (not illustrated in the figure).

The flexible element is wound on a pulley 55*a* adapted to maintain the final portion of the flexible element, the one fixed to the board 20, in a substantially vertical position, placing the suspension means in tension in a balanced manner.

Said flexible element 55 can be placed under tension to a greater or lesser extent so as to prevent or only limit the lateral movements of the board 20.

Figure 4F:
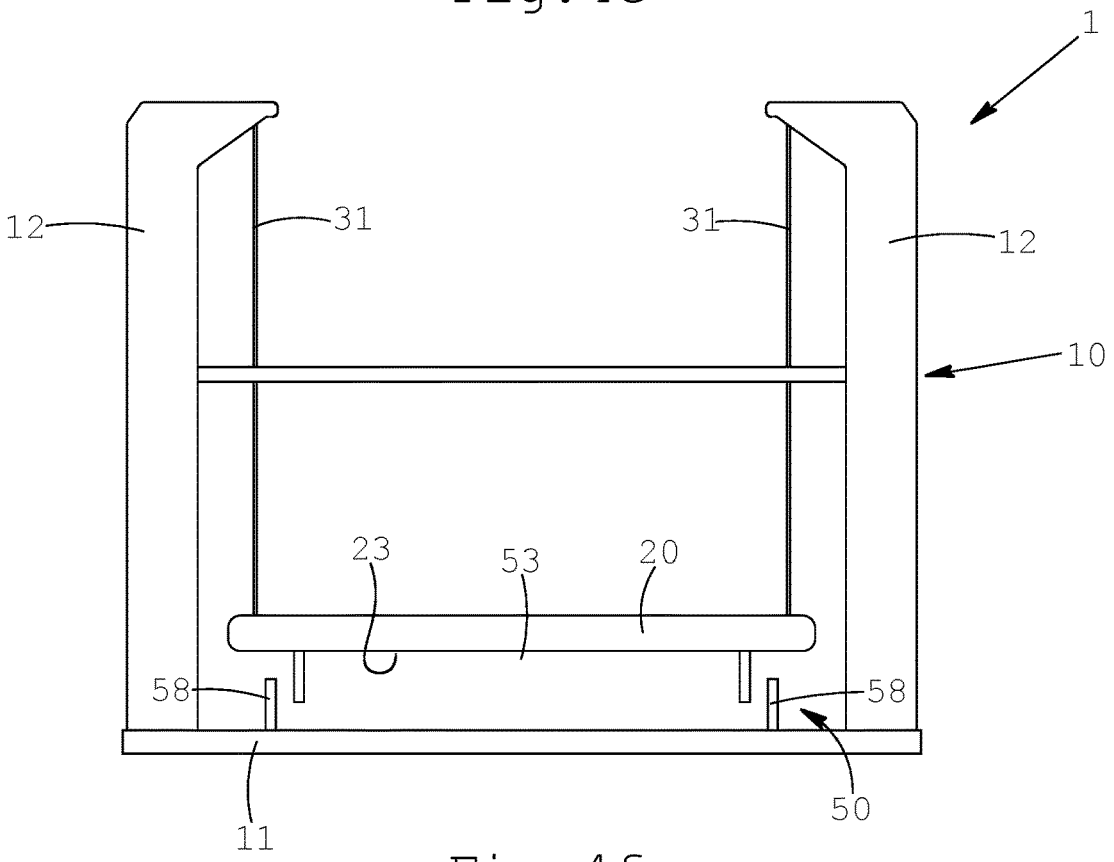

In yet another variant, illustrated in FIG. 4*f*, the limit stop means 50 comprise magnetic means. More in detail, said magnetic means comprise at least a pair of magnets 58, one element of which is mounted on the board 20 and the other is mounted on the static support structure 10. By suitably arranging said two or more pairs of magnets 58, it is possible to generate a force field that tends to hold the board 20 in a neutral or central position with respect to the static support structure 10.

Preferably, at least one of said elements is an electromagnet controlled by the control unit 100. Bu means of the control unit 100 it is possible to adjust the intensity of the electromagnet and consequently the force with which it opposes a lateral movement of the board 20.

According to the invention, the device can also comprise second actuator means adapted to impart oscillation movements of the board 20 in a controlled manner Said second actuator means are in fact connected to the control unit 100, which controls its activation in order to generate further motor interferences that tend to destabilize the person on the board.

According to a possible embodiment, said second actuator means, not illustrated in the figures, can comprise conventional actuators such as electric motors, pneumatic motors or the like, which can be connected to the board directly or, preferably, by means of flexible elements such as cords, ropes or the like.

According to this variant, said second actuator means can also be used as limit stop means to limit or prevent the oscillating movement.

Figure 5:
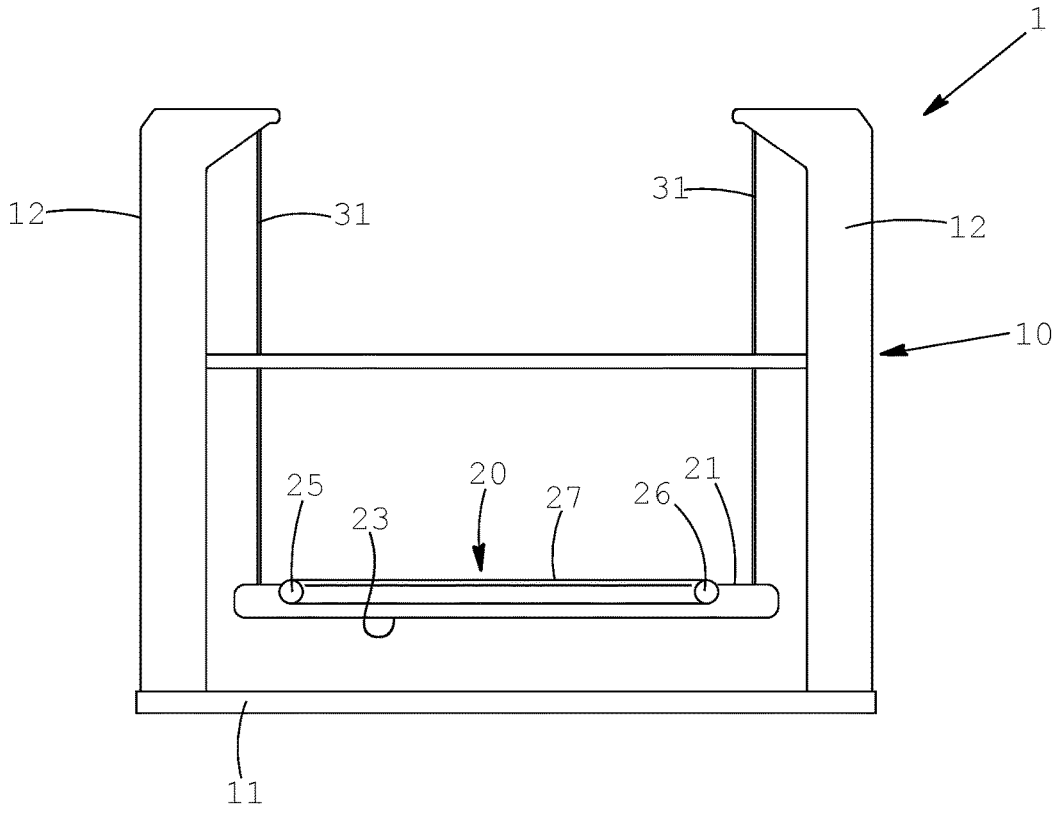
FIG. 5 is a lateral view of the device according to another variant of the invention.

FIG. 5 illustrates a further variant of the device in which a treadmill is integrated.

In this variant, the board 20 is connected to the static support structure 10 in the same way described for the variant of FIG. 1 or FIG. 3.

Hinged on the board 20 are two rollers 25, 26 arranged so that the respective rotation axes are parallel to each other and substantially parallel to the upper surface 21 of the board. In practice, the axes of the rollers 25, 26 lie in a plane substantially parallel to the upper surface 21.

Wound about said rollers is a belt 27 that has at least an upper branch positioned above said upper surface 21 of the board so that a person on the board can stand on it. A motor, not illustrated, is connected to at least one of said rollers 25, 26 to rotate said belt 27 and allow the person to walk or run on the board 20. The motor is connected to the control unit 100 and managed by it. For example, by means of the interface 101 of the control unit 100, it is possible to program both the speed of rotation of the belt 27 and the sequence of motor interferences generated by the rotations (tilting) of the board 20 or by its vertical translation.

As already mentioned, the object of the invention is to create motor interferences, generated through the rotations or the movements of the board 20, to stimulate the person during the performance of an exercise, or more in general of a predetermined movement, or in a condition of balance.

Rotations or movements of the board that are too brief or too slow might not be sufficient to generate motor interferences, i.e. suitable to stimulate the reaction of the body.

On the contrary, rotations or movements that are too fast or too broad could be dangerous for some subjects or during the performance of given exercises.

For this reason, the control unit 100 is preferably of programmable type. In particular, the control unit is configured to allow setting of given parameters concerning the sequence of motor interferences to be generated.

Typically, these parameters comprise one or more of the following quantities referred to a rotation and/or to a movement of the board 20:

the direction or the sense;

the amplitude;

the speed;

the acceleration.

According to tests carried out by the applicant, values suitable to generate motor interferences, for a rotation, are preferably included in the ranges below:

angular velocity from 0.05 rad/s to 0.5 rad/s and acceleration from 0.01 rad/s$^2$ to 0.1 rad/s$^2$.

In general, the amplitude of these rotations is preferably from 3° to 30°.

For a movement, values suitable to generate motor interferences are preferably included in the following ranges:

speed from 0.02 m/s to 0.5 m/s and acceleration from 0.01 m/s$^2$ to 0.05 m/s$^2$.

The amplitude of the movement is instead preferably from 5 mm to 250 mm.

These rotations and these movements must be understood with respect to a reference position of the board, for example the undisturbed position. The rotation and movement values indicated above are therefore to be considered absolute values.

These values are however indicative. For some exercises, both for professional training and for rehabilitation, they could undergo variations as a function of the subject performing the exercise or of the result to be obtained.

These parameters can be set individually or in groups of one or more parameters. Preferably, the control unit 100 is configured to store some programs with which given values of the aforesaid parameters are associated.

For example, these programs can be indicated for different types of physical exercises or for different levels of difficulty or of intensity of the motor interferences generated.

For this purpose, the control unit is advantageously provided with an interface 101 that allows viewing of the aforesaid parameters and/or their modification by a user. Said interface 101 comprises, for example, a screen, a keypad or a touchscreen.

Besides the aforesaid parameters, the control unit 101 according to the present invention can also allow programming of other parameters, such as the duration of the sequence of activations and deactivations of the first actuator means 40, the time interval between them (frequency) and/or the total number of movement cycles of the board (variations of position).

In a preferred variant, the control unit 100 is configured to program the sequence of motor interferences in conformity with a signal detected by sensor means 70, represented schematically in FIG. 1.

Said sensor means 70 can comprise, for example, one or more sensors capable of detecting one or more parameters that refer to the person performing the exercise and/or to the equipment used.

This allows the control unit 100 to receive said values measured and to modulate, also in real time, the intensity, the duration or the frequency of the motor interferences, as a function of the performance of the person performing the exercise.

Preferably said sensor means 70 can measure quantities, such as the position, the speed or the acceleration of at least a part of the body of the person performing the exercise and/or of a part of the equipment used.

For example, said sensor means 70 can detect the position of a dumbbell or a barbell held by the person, or the speed or the acceleration with which it is moved. Said sensor means can also detect the position, the speed or the acceleration of a movable part of a weight lifting machine or the speed of the belt of a treadmill positioned on the board 20. Said sensor means can also detect the position of the body of the person with respect to the supporting surface of the board 20.

According to another variant, said sensors 70 can instead be configured to detect the energy expenditure of the persona performing the exercise.

According to another aspect of the invention, the movable platform can comprise control means (not illustrated in the figure) connected to the control unit 100 and usable by a third person. Said third person can, for example, be a trainer in charge of monitoring the activity carried out by the person or by the people on the board 20.

According to the present invention, said control means are configured to control one or more parameters of the sequence of motor interferences. In this case, some parameters of the sequence (for example the amplitude, the speed and the acceleration) can be preset in the control unit 100, while other parameters (the sense or the direction of the movements, their frequency and duration) can be imparted in real time by said third person with the control means.

Said control means can, for example, comprise one or more accelerometers applicable to the body of the third person. The movement of a part of the body, for example of a limb, can be interpreted by the control unit 100 as a command to impart to the board 20, a rotation about a given axis or a movement.

Alternatively, or additionally, the control means can comprise a video camera adapted to film said third person. A recognition system, integrated in the control unit 100, is capable of detecting a given movement of the body of the third person and of generating a corresponding command for movement and/or rotation of the board 100.

According to another variant, the control means can comprise a voice control system that includes a microphone, usable by the third person, and a voice recognition system configured to associate a given word or phrase pronounced by the third person with a given command for movement or rotation of the board 20.

The invention claimed is:

1. A device for exercising muscles and balance comprising:

a board with a support surface to accommodate at least one person performing a physical exercise;

a static support structure;

a suspension system between the static structure and the board, the suspension system being configured to maintain the board suspended and raised off the ground, the suspension system is substantially inextensible; and at least one first actuator of said suspension system mounted on the static structure, wherein said suspension system comprises flexible and elongated members each having a first end connected to said at least one first actuator and a second opposite end connected to the board, said at least one first actuator being controllable by a controller configured to generate a sequence of activation and deactivation signals to move the suspension system and therefore to vary one or more of a height and an inclination of the board.

2. The device (1) according to claim 1, wherein the at least one first actuator comprises a plurality of actuators, and said suspension system comprises at least three flexible and elongated members, each of the flexible members being connected at the first end thereof to a respective one of the plurality of actuators moans.

3. The device according to claim 1, wherein the first ends of at least two of the flexible and elongated members are connected to a common single one of the at least one first actuator.

4. The device according to claim 1, wherein said at least one first actuator is selected from:

linear actuators, electric motors, magnetic actuators, and pneumatic actuators.

5. The device according to claim 1, wherein said at least one first actuator comprises at least a transmission member, said first end of the suspension system being connected to the transmission member, said transmission member being selected from:

pulleys or reels, connecting rods, articulated rods, and cams.

6. The device according to claim 1, further comprising a limit stop configured to limit or prevent an oscillation movement of the board.

7. The device according to claim 1, further comprising at least one second actuator configured to generate an oscillating movement of the board.

8. The device according to claim 1, wherein said controller is configured to calculate both activation and deactivation times of the at least one first actuator, and therefore both a duration of an activation cycle and a rest or deactivation time between one activation cycle and a next activation cycle, said calculating being repeated for a number of cycles equal to or greater than two.

9. The device according to claim 8, wherein activation and deactivation time intervals are random and are generated in real time by the controller during use, or are stored in a memory of said controller.

10. The device according to claim 1, wherein a rest or deactivation time between one activation cycle of the at least one first actuator and a next activation cycle is different at least from a preceding rest or deactivation time.

11. The device according to claim 1, wherein the controller is configured to vary, adjust or control one or more of parameters regarding movements of the board including one or more of an acceleration, a speed, an amplitude of movement, a rotation, a direction of movement, and a direction of rotation.

12. The device according to claim 1, further comprising a sensor, operatively connected to the controller, the sensor being configured to measure at least one parameter regarding the person performing the exercise, the controller being configured to calculate activation parameters of the at least one first actuator as a function of the at least one parameter measured by the sensor.

13. The device according to claim 12, wherein said at least one parameter is selected from one or more of:

an energy expenditure of the person, a heart rate of the person a position of one or more parts of the body of the person performing the exercise on the board, a speed of the one or more parts of the body of the person performing the exercise on the board, and an acceleration of the one or more parts of the body of the person performing the exercise on the board.

14. A device for exercising muscles and balance comprising:

a board with a support surface to accommodate at least one person performing a physical exercise;

a static support structure;

a suspension system between the static structure and the board, the suspension system being configured to maintain the board suspended and raised off the ground; and at least one first actuator of said suspension system mounted on the static structure, wherein said suspension system comprises flexible and elongated members each having a first end connected to said at least one first actuator and a second opposite end connected to the board, said at least one first actuator being controllable by a controller configured to generate a sequence of activation and deactivation signals to move the suspension system and therefore to vary one or more of a height and an inclination of the board, wherein the static support structure comprises guides to divert a direction of extension of the suspension system between a coupling point on the board and a coupling point on the at least one first actuator.

15. The device according to claim 14, wherein the static support structure further comprises columns disposed along a perimeter around the board, said guides being mounted on said columns.

16. The device according to claim 15, wherein the at least one first actuator is mounted on said columns or on a base of the static structure.

17. The device according to claim 14, wherein said guides comprise pulleys or rollers.

18. A device for exercising muscles and balance comprising:

a board with a support surface to accommodate at least one person performing a physical exercise;

a static support structure;

a suspension system between the static structure and the board, the suspension system being configured to maintain the board suspended and raised off the ground;

at least one actuator of said suspension system mounted on the static structure;

a pair of rollers rotatingly connected to the board and disposed so that respective rotation axes of the rollers are parallel to one another and substantially parallel to an upper surface of the board; and a belt wound around said rollers and having at least an upper branch positioned above said upper surface of the board, wherein said suspension system comprises flexible and elongated members each having a first end connected to said at least one actuator and a second opposite end connected to the board, said at least one actuator being controllable by a controller configured to generate a sequence of activation and deactivation signals to move the suspension system and therefore to vary one or more of a height and an inclination of the board.

19. The device of claim 18, further comprising a motor connected to at least one of the rollers to rotate the belt.

20. The device according to claim 18, further comprising a sensor, operatively connected to the controller, the sensor being configured to measure at least one parameter regarding the person performing the exercise, the controller being configured to calculate activation parameters of the at least one actuator as a function of the at least one parameter measured by the sensor.

* * * * *